US009279236B2

(12) United States Patent
Zhang et al.

(10) Patent No.: US 9,279,236 B2
(45) Date of Patent: Mar. 8, 2016

(54) ELECTRO-HYDRAULIC SYSTEM FOR RECOVERING AND REUSING POTENTIAL ENERGY

(75) Inventors: Jiao Zhang, Naperville, IL (US); Pengfei Ma, Naperville, IL (US); Tonglin Shang, Bolingbrook, IL (US); Gang Victor Wen, Dunlap, IL (US); Bryan Edward Nelson, Lacon, IL (US); Dayao Chen, Bolingbrook, IL (US)

(73) Assignee: Caterpillar Inc., Peoria, IL (US)

( * ) Notice: Subject to any disclaimer, the term of this patent is extended or adjusted under 35 U.S.C. 154(b) by 927 days.

(21) Appl. No.: 13/487,983

(22) Filed: Jun. 4, 2012

(65) Prior Publication Data

US 2013/0318955 A1 Dec. 5, 2013

(51) Int. Cl.
*F15B 13/00* (2006.01)
*E02F 9/22* (2006.01)
(Continued)

(52) U.S. Cl.
CPC ..... *E02F 9/2217* (2013.01); *E02F 9/2292* (2013.01); *E02F 9/2296* (2013.01); *F15B 21/14* (2013.01); *F15B 1/033* (2013.01);
(Continued)

(58) Field of Classification Search
CPC ..... F15B 2211/88; F15B 21/14; F15B 1/033; F15B 2211/20546; F15B 2211/20569; F15B 2211/20576; F15B 2211/212; F15B 2211/214; F15B 2211/30575; F15B 2211/3058; F15B 2211/6306; F15B 2211/6336; F15B 2211/6343; F15B 2211/6346; F15B 2211/7053; F15B 2211/7128; F15B 2211/761; F15B 2211/20507; E02F 9/2217; E02F 9/2296; E02F 9/2292
USPC ..... 60/413, 414, 416, 418
See application file for complete search history.

(56) References Cited

U.S. PATENT DOCUMENTS 4,369,625 A 1/1983 Izumi et al.
4,449,366 A 5/1984 Sato et al.
(Continued)

FOREIGN PATENT DOCUMENTS

CN 101225845 7/2008
EP 1 598 561 11/2005
(Continued)

OTHER PUBLICATIONS

Wang et al., Longke; "A Hydraulic Circuit with Dynamical Compensations," Georgia Institute of Technology.
(Continued)

*Primary Examiner* — Dwayne J White
*Assistant Examiner* — Logan Kraft
(74) *Attorney, Agent, or Firm* — Finnegan, Henderson, Farabow, Garrett & Dunner, LLP

(57) ABSTRACT

A hydraulic system includes a hydraulic actuator, a pump configured to supply fluid to the hydraulic actuator, and a first accumulator fluidly connected to the hydraulic actuator. The first accumulator is configured to store fluid received from the hydraulic actuator. The hydraulic system also includes a motor drivingly connected to the pump and fluidly connected to the first accumulator. The motor is configured to receive the stored fluid from the first accumulator to drive the pump. The hydraulic system further includes a first discharge valve fluidly connected between the first accumulator and the hydraulic actuator. The first discharge valve is configured to supply the stored fluid from the first accumulator to the hydraulic actuator without the stored fluid from the first accumulator circulating through the pump.

18 Claims, 4 Drawing Sheets

(51) Int. Cl.
*F15B 21/14* (2006.01)
*F15B 1/033* (2006.01)

(52) U.S. Cl.
CPC ..... *F15B2211/20507* (2013.01); *F15B 2211/20546* (2013.01); *F15B 2211/20569* (2013.01); *F15B 2211/20576* (2013.01); *F15B 2211/212* (2013.01); *F15B 2211/214* (2013.01); *F15B 2211/3058* (2013.01); *F15B 2211/30575* (2013.01); *F15B 2211/6306* (2013.01); *F15B 2211/6336* (2013.01); *F15B 2211/6343* (2013.01); *F15B 2211/6346* (2013.01); *F15B 2211/7053* (2013.01); *F15B 2211/7128* (2013.01); *F15B 2211/761* (2013.01); *F15B 2211/88* (2013.01)

(56) References Cited

U.S. PATENT DOCUMENTS

| | | | | |
|---|---|---|---|---|
| 4,561,249 | A | 12/1985 | Watanabe et al. | |
| 4,586,330 | A | 5/1986 | Watanabe et al. | |
| 4,768,339 | A | 9/1988 | Aoyagi et al. | |
| 4,833,798 | A | 5/1989 | Ehrich | |
| 5,048,293 | A | 9/1991 | Aoyagi | |
| 5,329,767 | A | 7/1994 | Hewett | |
| 5,630,316 | A | 5/1997 | Itsuji et al. | |
| 6,009,708 | A | 1/2000 | Miki et al. | |
| 6,151,894 | A | 11/2000 | Endo et al. | |
| 6,330,797 | B1 | 12/2001 | Kondo | |
| 6,378,301 | B2 | 4/2002 | Endo et al. | |
| 6,408,549 | B1 | 6/2002 | Quenzi et al. | |
| 6,434,864 | B1 | 8/2002 | Epshteyn | |
| 6,584,769 | B1 | 7/2003 | Bruun | |
| 6,634,653 | B2 | 10/2003 | Chatterjea | |
| 6,691,603 | B2 * | 2/2004 | Linerode et al. | 91/433 |
| 6,745,992 | B2 | 6/2004 | Yang et al. | |
| 6,789,335 | B1 | 9/2004 | Kinugawa et al. | |
| 6,789,387 | B2 | 9/2004 | Brinkman | |
| 6,918,247 | B1 | 7/2005 | Warner | |
| 7,121,189 | B2 | 10/2006 | Vonderwell et al. | |
| 7,191,846 | B2 | 3/2007 | Matsumoto et al. | |
| 7,243,591 | B2 | 7/2007 | Dixen et al. | |
| 7,260,931 | B2 | 8/2007 | Egelja et al. | |
| 7,269,944 | B2 * | 9/2007 | Zhang et al. | 60/414 |
| 7,272,928 | B2 | 9/2007 | Ariga et al. | |
| 7,412,827 | B2 | 8/2008 | Verkuilen | |
| 7,434,391 | B2 | 10/2008 | Asam et al. | |
| 7,487,707 | B2 | 2/2009 | Pfaff et al. | |
| 7,490,421 | B1 | 2/2009 | Pletzer et al. | |
| 7,516,613 | B2 | 4/2009 | Kadlicko | |
| 7,516,614 | B2 | 4/2009 | Bitter | |
| 7,596,893 | B2 | 10/2009 | Tozawa et al. | |
| 7,634,911 | B2 * | 12/2009 | Brinkman | 60/414 |
| 7,712,309 | B2 * | 5/2010 | Vigholm | 60/414 |
| 7,823,379 | B2 | 11/2010 | Hamkins et al. | |
| 7,905,088 | B2 * | 3/2011 | Stephenson et al. | 60/414 |
| 7,908,852 | B2 | 3/2011 | Zhang et al. | |
| 8,209,975 | B2 * | 7/2012 | Persson et al. | 60/414 |
| 2003/0121408 | A1 | 7/2003 | Linerode et al. | |
| 2004/0083629 | A1 | 5/2004 | Kondou | |
| 2004/0118623 | A1 | 6/2004 | Shore et al. | |
| 2004/0123499 | A1 | 7/2004 | Arii | |
| 2005/0012337 | A1 | 1/2005 | Yoshimatsu | |
| 2005/0036894 | A1 | 2/2005 | Oguri | |
| 2005/0196288 | A1 | 9/2005 | Cherney | |
| 2007/0044463 | A1 | 3/2007 | VerKuilen et al. | |
| 2007/0068049 | A1 | 3/2007 | Quenzi et al. | |
| 2007/0295005 | A1 | 12/2007 | Fleischmann | |
| 2008/0104955 | A1 | 5/2008 | Khalil | |
| 2008/0110166 | A1 | 5/2008 | Stephenson et al. | |
| 2008/0155975 | A1 | 7/2008 | Brinkman | |
| 2008/0250783 | A1 | 10/2008 | Griswold | |
| 2008/0300757 | A1 | 12/2008 | Kanayama et al. | |
| 2008/0314038 | A1 | 12/2008 | Tozawa et al. | |
| 2008/0314607 | A1 | 12/2008 | May | |
| 2009/0000290 | A1 | 1/2009 | Brinkman | |
| 2009/0077837 | A1 | 3/2009 | Tozawa et al. | |
| 2009/0165450 | A1 | 7/2009 | Cherney et al. | |
| 2009/0217653 | A1 | 9/2009 | Zhang et al. | |
| 2009/0288408 | A1 | 11/2009 | Tozawa et al. | |
| 2010/0000209 | A1 | 1/2010 | Wada et al. | |
| 2010/0000211 | A1 | 1/2010 | Ikeda et al. | |
| 2010/0043420 | A1 | 2/2010 | Ikeda et al. | |
| 2010/0089049 | A1 | 4/2010 | Matsuura et al. | |
| 2010/0107620 | A1 | 5/2010 | Nelson et al. | |
| 2010/0115936 | A1 | 5/2010 | Williamson et al. | |
| 2010/0162593 | A1 | 7/2010 | Hughes, IV et al. | |
| 2010/0162885 | A1 | 7/2010 | Hughes, IV et al. | |
| 2010/0163258 | A1 | 7/2010 | Hughes, IV et al. | |
| 2010/0218493 | A1 | 9/2010 | Nakamura et al. | |
| 2010/0236232 | A1 | 9/2010 | Boehm et al. | |
| 2011/0029206 | A1 | 2/2011 | Kang et al. | |
| 2011/0030364 | A1 | 2/2011 | Persson et al. | |
| 2011/0302914 | A1 | 12/2011 | Helbling | |
| 2012/0067432 | A1 | 3/2012 | Vigholm et al. | |
| 2014/0123633 | A1 | 5/2014 | Rosth | |

FOREIGN PATENT DOCUMENTS

| | | | |
|---|---|---|---|
| GB | 2 269 425 | | 2/1994 |
| JP | 56-016735 | | 2/1981 |
| JP | 57-134007 | | 8/1982 |
| JP | 58-044133 | | 3/1983 |
| JP | 63-067403 | | 3/1988 |
| JP | 02-108733 | | 4/1990 |
| JP | 05-287774 | | 11/1993 |
| JP | 06-057786 | | 3/1994 |
| JP | 08-014201 | A | 1/1996 |
| JP | 10-96402 | | 4/1998 |
| JP | 10-103112 | | 4/1998 |
| JP | 2004-125094 | | 4/2004 |
| JP | 2005-003183 | | 1/2005 |
| JP | 2005-155230 | A | 6/2005 |
| JP | 2006-118685 | | 5/2006 |
| JP | 2006-312995 | | 11/2006 |
| JP | 2006322578 | | 11/2006 |
| JP | 2007-247701 | | 9/2007 |
| JP | 2008089023 | | 4/2008 |
| JP | 2008128478 | | 6/2008 |
| JP | 2010-084888 | | 4/2010 |
| JP | 2010084888 | | 4/2010 |
| JP | 2011-069432 | | 4/2011 |
| JP | 2011-179280 | A | 9/2011 |
| KR | 100641388 | | 10/2006 |
| KR | 1020060078300 | | 7/2009 |
| KR | 1020100075340 | | 7/2010 |
| WO | WO 2005/024246 | | 3/2005 |
| WO | WO 2009/084853 | | 7/2009 |
| WO | WO 2009/123047 | | 10/2009 |
| WO | WO 2010/040890 | | 4/2010 |
| WO | WO 2011/041410 | | 4/2011 |
| WO | 2011145947 | | 11/2011 |

OTHER PUBLICATIONS

Wang et al., Longke; "Application of Singular Perturbation Theory to Hydraulic Pump Controlled Systems," Fellow, IEEE (2010).

Williamson et al., Christopher, "Stability and Motion Control of Inertial Loads With Displacement Controlled Hydraulic Actuators," Purdue University (2010).

Linjama, M. (2011) entitled "Digital Fluid Power-State of the Art", The 12$^{th}$ Scandinavian International Conference on Fluid Power, May 18-20, 2011, Tampere, Finland.

Zimmerman, J. PhD Student/Purdue University, Center for Compact and Efficient Fluid Power PowerPoint Presentation, 2010 Annual Meeting (Jun. 14).

Zimmerman, J. et al., "Hybrid Displacement Controlled Multi-Actuator Hydraulic Systems", The Twelfth Scandinavian International Conference on Fluid Power , Tampere, Finland (May 18-20, 2011).

Linde Hydraulics Brochure entitled "HPV-02. Variable Pumps for Closed Loop Operation", pp. 1-36.

(56) References Cited

OTHER PUBLICATIONS

Brezonick, M., entitled "The Potential of Pump-Controlled Hydraulics", Hydraulic Horizons, Diesel Progress North American Edition (Jan. 2009).
Zick, J., entitled "Verbesserte Leistungsausnutzung bei Erdbaumaschinen durch optimal Pumpensteuerung", Olhydraulic und pneumatic 20 (1976) Nr. 4.
U.S. Appl. No. 13/170,960 of Pengfei Ma et al. "Hydraulic Control System Having Energy Recovery Kit," filed Jun. 30, 2011.
U.S. Appl. No. 13/171,007 of Pengfei Ma et al. "Hydraulic Control System Having Swing Energy Recovery," filed Jun. 30, 2011.
U.S. Appl. No. 13/171,047 of Jiao Zhang et al. "Hydraulic Control System Having Swing Motor Energy Recovery," filed Jun. 30, 2011.
U.S. Appl. No. 13/171,110 of Jiao Zhang et al. "Hydraulic Control System Having Swing Motor Energy Recovery," filed Jun. 30, 2011.
U.S. Appl. No. 13/171,146 of Jiao Zhang et al. "Energy Recovery System Having Accumulator and Variable Relief," filed Jun. 30, 2011.
U.S. Appl. No. 13/222,895 by Patrick Opdenbosch et al., entitled "Meterless Hydraulic System Having Displacement Control Valve," filed Aug. 31, 2011.
U.S. Appl. No. 13/222,945 by Patrick Opdenbosch et al., entitled "Meterless Hydraulic System Having Restricted Primary Makeup," filed Aug. 31, 2011.
U.S. Appl. No. 13/222,990 by Patrick Opdenbosch et al., entitled "Meterless Hydraulic System Having Load-Holding Bypass," filed Aug. 31, 2011.
U.S. Appl. No. 13/249,932 by Bryan E. Nelson et al., entitled "Regeneration Configuration for Closed-Loop Hydraulic Systems," filed Sep. 30, 2011.
U.S. Appl. No. 13/250,067 by Patrick Opdenbosch, entitled "Meterless Hydraulic System Having Multi-Actuator Circuit," filed Sep. 30, 2011.
U.S. Appl. No. 13/250,250 by Patrick Opdenbosch, entitled "Meterless Hydraulic System Having Multi-Actuator Circuit," filed Sep. 30, 2011.
U.S. Appl. No. 13/250,002 by Michael L. Knussman, entitled "Closed-Loop Hydraulic System Having Energy Recovery," filed Sep. 30, 2011.
U.S. Appl. No. 13/250,171 of Patrick Opdenbosch, entitled "Meterless Hydraulic System Having Pump Protection," filed Sep. 30, 2011.
U.S. Appl. No. 13/278,623 of Patrick Opdenbosch, entitled "Closed-Loop Hydraulic System Having Flow Combining and Recuperation," filed Oct. 21, 2011.
U.S. Appl. No. 13/279,064 of Patrick Opdenbosch et al., entitled "Meterless Hydraulic System Having Flow Sharing and Combining Functionality," filed Oct. 21, 2011.
U.S. Appl. No. 13/279,177 of Patrick Opdenbosch et al., entitled "Meterless Hydraulic System Having Flow Sharing and Combining Functionality," filed Oct. 21, 2011.
U.S. Appl. No. 13/278,556 of Michael L. Knussman, entitled "Closed-Loop Hydraulic System Having Regeneration Configuration," filed Oct. 21, 2011.
U.S. Appl. No. 13/278,894 of Patrick Opdenbosch, entitled "Hydraulic System Having Flow Combining Capabilities," filed Oct. 21, 2011.
U.S. Appl. No. 13/278,895 of Michael L. Knussman et al., entitled "Hydraulic System," filed Oct. 21, 2011.
U.S. Appl. No. 13/278,939 of Michael L. Knussman, entitled "Hydraulic System," filed Oct. 21, 2011.
U.S. Appl. No. 13/278,745 of Brad A. Edler et al., entitled "Closed-Loop System Having Multi-Circuit Flow Sharing," filed Oct. 21, 2011.
U.S. Appl. No. 13/278,650 of Michael L. Knussman, entitled "Hydraulic System Having Multiple Closed-Loop Circuits," filed Oct. 21, 2011.
U.S. Appl. No. 13/278,479 of Brad A. Edler et al., entitled "Closed-Loop Hydraulic System Having Priority-Based Sharing," filed Oct. 21, 2011.
U.S. Appl. No. 13/278,589 of Michael L. Knussman, entitled "Hydraulic System Having Multiple Closed-Loop Circuits," filed Oct. 21, 2011.
U.S. Appl. No. 13/278,788 of Jeffrey L. Kuehn et al., entitled "Closed-Loop Hydraulic System Having Force Modulation," filed Oct. 21, 2011.
U.S. Appl. No. 13/278,491 of Jeffrey L. Kuehn et al., entitled "Meterless Hydraulic System Having Sharing and Combining Functionality," filed Oct. 21, 2011.
U.S. Appl. No. 13/278,935 of Michael L. Knussman et al., entitled "Hydraulic System," filed Oct. 21, 2011.

* cited by examiner

ELECTRO-HYDRAULIC SYSTEM FOR RECOVERING AND REUSING POTENTIAL ENERGY

TECHNICAL FIELD

The present disclosure relates generally to an electro-hydraulic system and, more particularly, to an electro-hydraulic system for recovering and reusing potential energy.

BACKGROUND

A machine (e.g., a wheel loader, an excavator, a front shovel, a bulldozer, a backhoe, a telehandler, etc.) may be used to move heavy loads, such as earth, construction material, and/or debris. The machine may utilize an implement to move the loads. The implement may be powered by a hydraulic system that may use pressurized fluid to actuate a hydraulic actuator to move the implement.

During operation of the machine, the implement may be raised to an elevated position. As the implement may be relatively heavy, the implement may gain potential energy when raised to the elevated position. As the implement is released from the elevated position, this potential energy may be converted to heat when pressurized hydraulic fluid is forced out of the hydraulic actuator and is throttled across a valve and returned to a tank. The conversion of potential energy into heat may result in an undesired heating of the discharged hydraulic fluid, which may require that the machine possess additional cooling capacity. Recovering that lost or wasted potential energy for reuse may improve machine efficiency.

One system designed to recycle the energy associated with lowering a load is disclosed in U.S. Pat. No. 6,584,769 to Bruun ("Bruun"). Bruun discloses a hydraulic circuit that includes a variable hydraulic machine, a servo pump, and an accumulator. During operation, pressurized oil in the accumulator flows through a bi-directional pump of the variable hydraulic machine, which then conveys the oil to a lifting cylinder. In the event of a lowering movement, the direction of flow in the bi-directional pump is changed and oil is supplied to the accumulator. However, the hydraulic circuit in Bruun may not efficiently recover or reuse potential energy from the lowered load, and the system may be relatively complex and costly.

The system of the present disclosure is directed toward solving one or more of the problems set forth above and/or other problems of the prior art.

SUMMARY

In one aspect, the present disclosure is directed to a hydraulic system. The hydraulic system includes a hydraulic actuator, a pump configured to supply fluid to the hydraulic actuator, and a first accumulator fluidly connected to the hydraulic actuator. The first accumulator is configured to store fluid received from the hydraulic actuator. The hydraulic system also includes a motor drivingly connected to the pump and fluidly connected to the first accumulator. The motor is configured to receive the stored fluid from the first accumulator to drive the pump. The hydraulic system further includes a first discharge valve fluidly connected between the first accumulator and the hydraulic actuator. The first discharge valve is configured to supply the stored fluid from the first accumulator to the hydraulic actuator without the stored fluid from the first accumulator circulating through the pump.

In another aspect, the present disclosure is directed to a method of recovering and reusing energy with a hydraulic system. The method includes directing fluid from a hydraulic actuator to a first accumulator to store fluid in the first accumulator, determining an accumulator pressure associated with the fluid stored in the first accumulator, and determining an actuator pressure associated with fluid supplied to the hydraulic actuator. The method also includes directing the stored fluid from the first accumulator to the hydraulic actuator without the stored fluid from the first accumulator circulating through a pump when a first condition associated with the accumulator and actuator pressures is satisfied. The method further includes directing the stored fluid from the first accumulator to a motor driving the pump when a second condition associated with the accumulator and actuator pressures is satisfied. The second condition is different from the first condition.

In another aspect, the present disclosure is directed to a hydraulic system. The hydraulic system includes a hydraulic actuator, a first pump configured to supply fluid to the hydraulic actuator, and a power source configured to supply power to drive the first pump. The hydraulic system also includes a first accumulator fluidly connected to the hydraulic actuator and configured to store fluid received from the hydraulic actuator. The hydraulic system further includes a device drivingly connected to the first pump. The device is configured to operate in a first mode as a motor to receive the stored fluid from the first accumulator to drive the first pump, and configured to operate in a second mode as a second pump to supply pressurized fluid to the first accumulator.

DETAILED DESCRIPTION

Reference will now be made in detail to exemplary embodiments of the invention, examples of which are illustrated in the accompanying drawings. Wherever possible, the same reference numbers will be used throughout the drawings to refer to the same or like parts.

Figure 1:
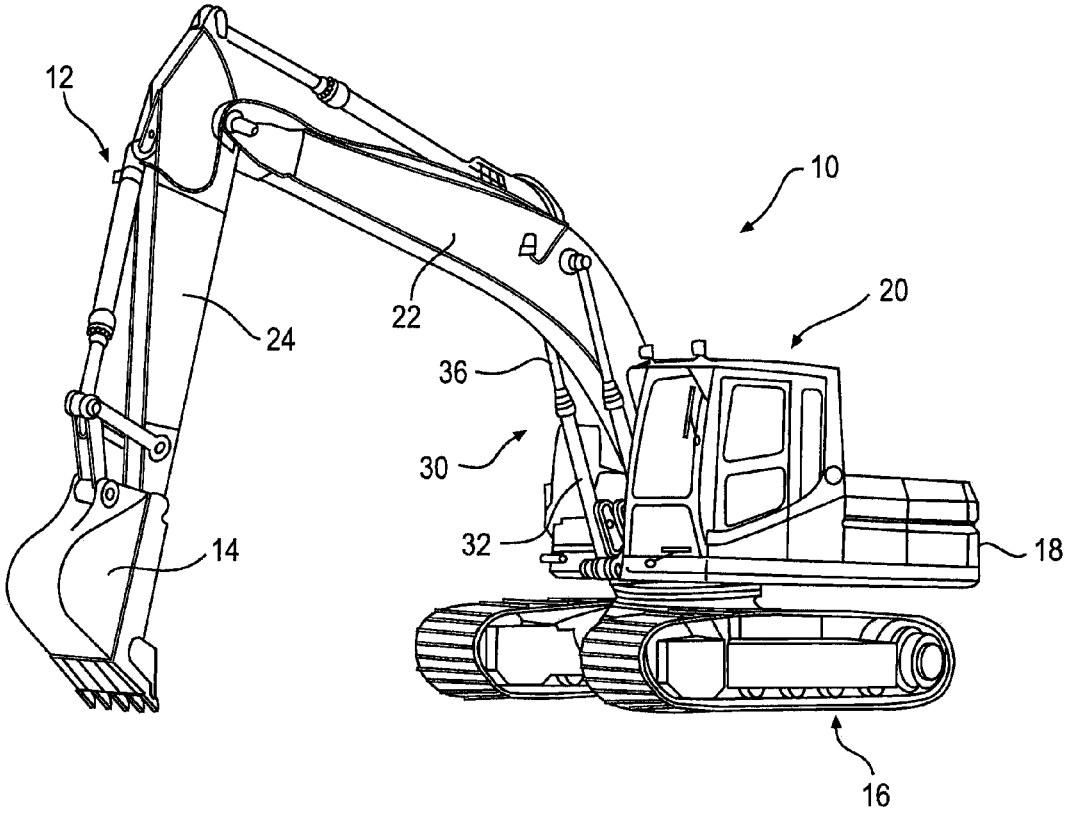
FIG. 1 is a pictorial illustration of an exemplary disclosed machine.

FIG. 1 illustrates an exemplary machine 10 having multiple systems and components that cooperate to accomplish a task. The machine 10 may embody a fixed or mobile machine that performs some type of operation associated with an industry such as mining, construction, farming, transportation, or another industry known in the art. For example, the machine 10 may be an earth moving machine such as an excavator (shown in FIG. 1), a wheel loader, a front shovel, a bulldozer, a backhoe, a telehandler, a motor grader, a dump truck, or any other earth moving machine. The machine 10 may include an implement system 12 configured to move a work tool 14, a drive system 16 for propelling the machine 10, a power source 18 that provides power to the implement system 12 and the drive system 16, and an operator station 20 situated for manual control of the implement system 12, the drive system 16, and/or the power source 18.

Figure 2:
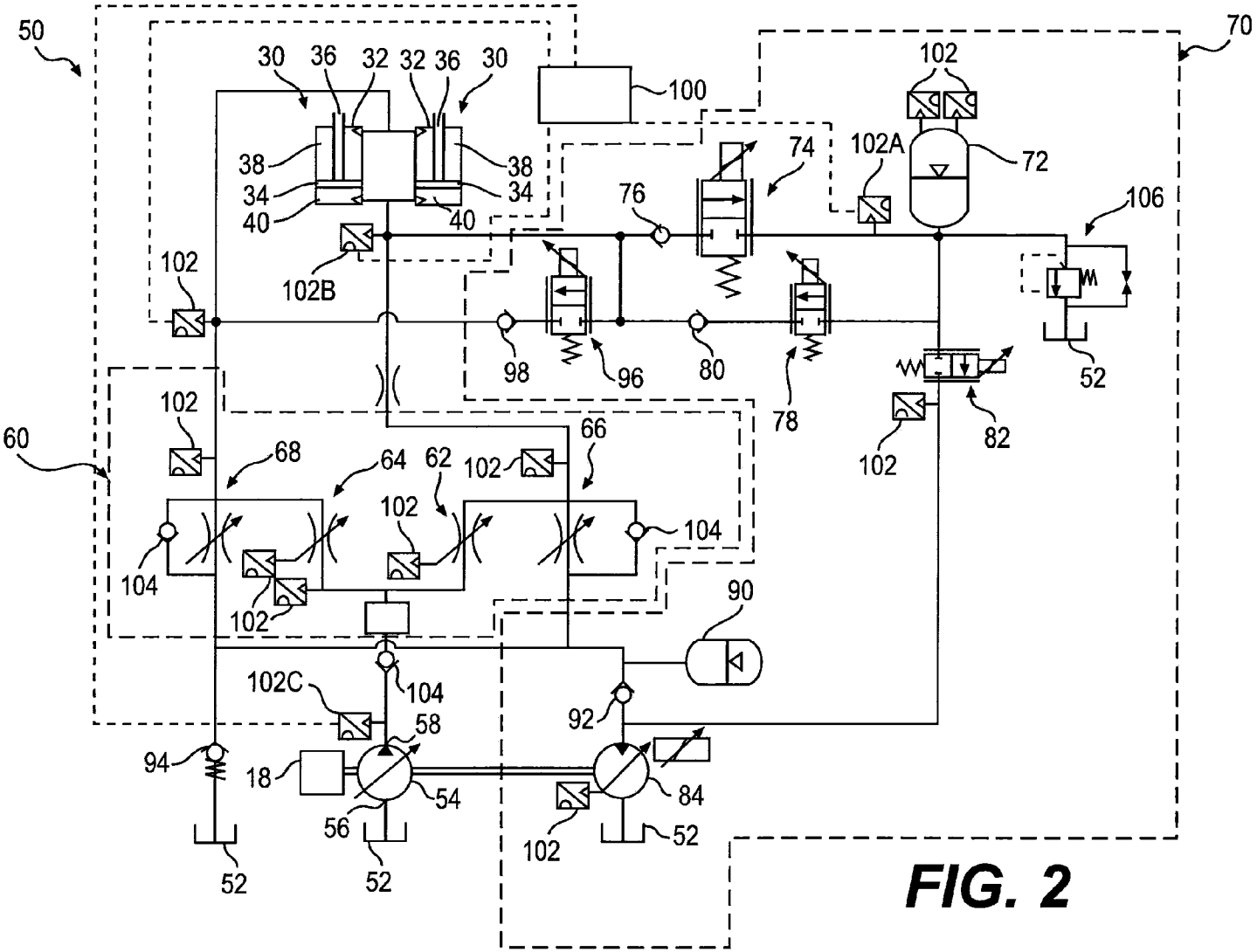
FIG. 2 is a schematic illustration of an exemplary disclosed system that may be used in conjunction with the machine of FIG. 1, according to an embodiment.

The implement system 12 may include a linkage structure acted on by one or more hydraulic actuators, such as hydraulic cylinders, to move the work tool 14. The hydraulic actuators may include any device configured to receive pressurized hydraulic fluid, and convert a hydraulic pressure and/or flow from the pressurized hydraulic fluid into a mechanical force and/or motion. For example, the implement system 12 may also include a boom 22 and a stick 24 for pivotally connecting the work tool 14 to a body of the machine 10. In an embodiment, the boom 22 may be vertically pivotal about a horizontal axis relative to a work surface by one or more hydraulic cylinders 30. As shown in FIGS. 1 and 2, a pair of adjacent, double-acting, hydraulic cylinders 30 may pivotally connect the boom 22 to the body of the machine 10. The stick 24 may be pivotally connected at one end to the boom 22 and at the opposite end to the work tool 14. One or more hydraulic cylinders may also be provided between the stick 24 and the work tool 14 in order to pivot the work tool 14, and/or between the boom 22 and the stick 24 in order to pivot the stick 24.

Numerous different work tools 14 may be attachable to a single machine 10 and may be operator controllable. The work tool 14 may include any device used to perform a particular task such as, for example, a bucket, a fork arrangement, a blade, a shovel, a ripper, a dump bed, a broom, a snow blower, a propelling device, a cutting device, a grasping device, or any other task-performing device known in the art. Although connected in the embodiment of FIG. 1 to pivot in the vertical direction relative to the body of the machine 10 and to swing in the horizontal direction, the work tool 14 may alternatively or additionally rotate, slide, open and close, or move in any other manner known in the art.

The power source 18 may embody an engine such as, for example, a diesel engine, a gasoline engine, a gaseous fuel-powered engine, or any other type of combustion engine known in the art. It is contemplated that the power source 18 may alternatively embody a non-combustion source of power such as a fuel cell, a power storage device, or another source known in the art. The power source 18 may produce a mechanical or electrical power output that may then be converted to hydraulic power for moving the hydraulic cylinders 30 (and/or other hydraulic actuators) and/or one or more pumps as described below.

The operator station 20 may include devices that receive input from an operator indicative of desired machine maneuvering. Specifically, the operator station 20 may include one or more operator interface devices (e.g., a joystick, a steering wheel, a pedal, etc.) that are located proximate an operator seat. The operator interface devices may initiate movement of the machine 10 (e.g., travel and/or tool movement) by producing displacement signals that are indicative of desired machine maneuvering. As an operator moves the interface device, the operator may affect a corresponding machine movement in a desired direction, with a desired speed, and/or with a desired force.

As shown in FIG. 2, each hydraulic cylinder 30 may include a housing 32 and a piston 34. The housing 32 may include a vessel having an inner surface forming an internal chamber. In an embodiment, the housing 32 may include a substantially cylindrically-shaped vessel having a cylindrical bore therein defining the inner surface. The piston 34 may be closely and slidably received against the inner surface of the housing 32 to allow relative movement between the piston 34 and the housing 32.

A rod 36 may be connected on one end to the piston 34, as shown in FIG. 2, and on another end to directly or indirectly to the boom 22, as shown in FIG. 1. The piston 34 may divide the internal chamber of the housing 32 into a rod-end chamber 38 corresponding to the portion of the internal chamber on the rod-end side of the housing 32, and a head-end chamber 40 corresponding to the portion of the internal chamber of the housing 32 opposite the rod-end side. The rod-end and head-end chambers 38, 40 may each be selectively supplied with pressurized fluid and drained of the pressurized fluid via respective apertures in the housing 22 to cause the piston 34 to displace within the housing 32, thereby changing an effective length of the hydraulic cylinders 30, which moves the boom 22. A flow rate of fluid into and out of the rod-end and head-end chambers 38, 40 may relate to a translational velocity of the hydraulic cylinders 30, while a pressure differential between the rod-end and head-end chambers 38, 40 may relate to a force imparted by the hydraulic cylinders 30 on the associated linkage structure of implement system 12.

As illustrated in FIG. 2, the machine 10 may include a hydraulic circuit or system 50 having a plurality of fluid components that cooperate to selectively direct pressurized hydraulic fluid into and out of one or more hydraulic actuators to perform a task. For example, in the embodiment shown in FIG. 2, the hydraulic system 50 selectively directs pressurized hydraulic fluid into and out of the hydraulic cylinders 30 to move the boom 22. The hydraulic system 50 may include a tank 52, a pump 54, a cylinder control valve assembly 60, and an energy recovery system 70. The hydraulic system 50 may also include other hydraulic actuators of the machine 10.

The tank 52 may include a source of low-pressure hydraulic fluid, such as, for example, a fluid reservoir. The fluid may include a dedicated hydraulic oil, an engine lubrication oil, a transmission lubrication oil, and/or other suitable working fluid. The hydraulic system 50 may selectively draw fluid from and return fluid to the tank 52 during operation of the implement system 12. Although only a single tank 52 is shown, it is also contemplated that the hydraulic system 50 may be in fluid communication with multiple, separate fluid tanks.

The pump 54 may be configured to produce a flow of pressurized hydraulic fluid, and may include, for example, a piston pump, gear pump, vane pump, or gerotor pump. The pump 54 may have a variable displacement capacity, or, in the alternative, a fixed capacity for supplying the flow. The pump 54 may include a pump inlet 56 and a pump outlet 58. The pump inlet 56 may be connected to the tank 52 by a fluid line. In operation, the pump 54 may draw hydraulic fluid from the tank 52 at ambient or low pressure, and may convert mechanical energy or power to hydraulic energy or power by pressurizing the hydraulic fluid. The pressurized hydraulic fluid flow may exit through the pump outlet 58.

The pump 54 may include a stroke-adjusting mechanism, for example a swashplate, a position of which is hydro-mechanically or electro-hydraulically adjusted based on, among other things, a desired speed of the hydraulic actuators in the hydraulic system 50 (e.g., the hydraulic cylinders 30) to thereby vary an output (e.g., a discharge rate) of the pump 54. The displacement of the pump 54 may be adjusted from a zero displacement position at which substantially no fluid is discharged from the pump 54, to a maximum displacement position at which fluid is discharged from the pump 54 at a maximum rate. The pump 54 may be drivably connected to the power source 18 by, for example, a countershaft, a belt, or in another suitable manner. Alternatively, the pump 54 may be indirectly connected to the power source 18 via a coupling 19 (FIGS. 3 and 4), a torque converter, a gear box, an electrical circuit, or in any other manner known in the art. The pump 54 may be dedicated to supplying pressurized hydraulic fluid to the hydraulic cylinders 30 and/or other hydraulic actuators of the machine 10.

The cylinder control valve assembly 60 may include an independent metering valve unit, including two pump-to-cylinder ("P-C") independent metering control valves 62 and 64 and two cylinder-to-tank ("C-T") independent metering control valves 66 and 68. The P-C and C-T independent metering control valves 62, 64, 66, and 68 may each be independently actuated into open and closed conditions, and positions between open and closed. Through selective actuation of the P-C and C-T control valves 62, 64, 66, and 68, pressurized hydraulic fluid may be directed into and out of the rod-end and head-end chambers 38, 40 of each hydraulic cylinder 30. By controlling the direction and rate of fluid flow to and from the rod-end and head-end chambers 38, 40, the P-C and C-T control valves 62, 64, 66, and 68 may control the motion of the implement system 12. Additionally or alternatively, the cylinder control valve assembly 60 may include one or more single spool valves (not shown), proportional control valves, or any other suitable devices configured to control the rate of pressurized hydraulic fluid flow entering into and exiting out of the hydraulic cylinders 30.

The P-C control valves 62 and 64 may be configured to direct pressurized hydraulic fluid exiting from the pump outlet 58 into the hydraulic cylinders 30. In an embodiment, the P-C control valve 62 may selectively direct hydraulic flow into the head-end chambers 40 of the hydraulic cylinders 30 (e.g., via one or more fluid lines that fluidly connect the P-C control valve 62 to the head-end chambers 40 in parallel), and the P-C control valve 64 may selectively direct hydraulic flow into the rod-end chambers 38 (e.g., via one or more fluid lines that fluidly connects the P-C control valve 64 to the rod-end chambers 38 in parallel). Also, the P-C control valves 62 and 64 may be configured to fluidly connect the head-end chambers 40 and the rod-end chambers 38.

The C-T control valves 66 and 68 may be configured to direct hydraulic fluid exiting from the hydraulic actuators 30 to the tank 52. In an embodiment, the C-T control valve 66 may receive hydraulic fluid leaving the head-end chambers 40 and direct the hydraulic fluid towards the tank 52 (e.g., via one or more fluid lines that fluidly connect the head-end chambers 40 in parallel to the C-T control valve 66). The C-T control valve 68 may receive hydraulic fluid leaving the rod-end chambers 38 and direct the hydraulic fluid towards the tank 52 (e.g., via one or more fluid lines that fluidly connect the rod-end chambers 38 in parallel to the C-T control valve 68). The C-T control valves 66 and 68, like the P-C control valves 62 and 64, may include various types of independently adjustable valve devices.

In an embodiment, the energy recovery system 70 may include a high-pressure ("HP") accumulator 72, an accumulator charge valve 74, check valves 76, 80, a cylinder discharge valve 78, a motor discharge valve 82, and a motor 84. The energy recovered by the energy recovery system 70 may be used to provide power for subsequent movements and operations of the hydraulic cylinders 30 and/or other hydraulic actuators of the machine 10.

For example, the energy recovery system 70 may recover energy associated with the pressurized hydraulic fluid discharged from the hydraulic cylinders 30 under an overrunning load condition. An overrunning load condition may exist when retraction is desired after the hydraulic cylinders 30 have been extended to lift a load. In the overrunning load condition, the hydraulic cylinders 30 may be retracted by the force of gravity on the implement system 12 and/or the force of gravity on the load carried by the implement system 12 (e.g., by opening the P-C control valve 64 and closing the P-C control valve 62 and the C-T control valve 68). This retraction may cause movement of the pistons 34 in the direction of the respective head-end chambers 40, thus resulting in pressurized hydraulic fluid being forced out of the head-end chambers 40. The overrunning load condition may be distinguished from a resistive load condition where the hydraulic cylinders 30 must work against the weight of the implement system 12 and/or the force of gravity on the load to perform a movement or operation. The resistive load condition may exist when extending the hydraulic cylinders 30, e.g., lifting the pistons 34 against the force of gravity.

The accumulator charge valve 74 may fluidly connect the head-end chambers 40 to the HP accumulator 72. In the overrunning load condition, the accumulator charge valve 74 may be actuated to an open position while the C-T control valve 66 may be actuated to a closed position, thus allowing pressurized hydraulic fluid exiting the head-end chambers 40 to enter (or charge) the HP accumulator 72. The accumulator charge valve 74 may work in conjunction with the check valve 76 such that when the accumulator charge valve 74 is in the open position, the check valve 76 may allow pressurized hydraulic fluid to flow from the head-end chambers 40 to the HP accumulator 72, but not in the reverse direction. In non-overrunning load conditions (such as the resistive load condition), the accumulator charge valve 74 may be in a closed position to prevent entry of pressurized hydraulic fluid exiting the head-end chambers 40 into the HP accumulator 72 (or vice versa).

As the amount of pressurized hydraulic fluid within the HP accumulator 72 increases so may the pressure within the HP accumulator 72, thus making it more difficult for pressurized hydraulic fluid to travel from the head-end chambers 40 to the HP accumulator 72. Once the pressure within the HP accumulator 72 equals the pressure within the head-end chambers 40, the pressurized hydraulic fluid may stop flowing from the head-end chambers 40 to the HP accumulator 72. The pressurized hydraulic fluid may hold the hydraulic cylinders 30 in their current positions, allowing the HP accumulator 72 to act as a spring or shock absorber by reducing the amount of "bounce" of the implement system 12 as the machine 10 moves over uneven surfaces at a work site. If continued movement of the hydraulic cylinders 30 is desired, the pump 54 may supply pressurized hydraulic fluid into the rod-end chambers 38 of the hydraulic cylinders 30 (e.g., via the P-C control valve 64) to increase the pressure within the head-end chambers 40 by driving the respective pistons 34 in the direction of the head-end chambers 40. As such, the pressure in the head-end chambers 40 may be consistently maintained at a level greater than the pressure within the HP accumulator 72 and the pistons 34 may function smoothly in the overrunning load condition without experiencing a stoppage.

The cylinder discharge valve 78 and the motor discharge valve 82 may be located in fluid lines that fluidly connect the HP accumulator 72 to the hydraulic cylinders 30 and the motor 84, respectively, to reuse (or discharge) the pressurized hydraulic fluid stored in the HP accumulator 72. In the overrunning load condition, the cylinder discharge valve 78 and the motor discharge valve 82 may be in respective closed positions, thus causing pressurized hydraulic fluid exiting from the head-end chambers 40 to accumulate within and charge the HP accumulator 72. When extension of the hydraulic cylinders 30 is desired, e.g., in the resistive load condition or other non-overrunning load condition, the cylinder discharge valve 78 and/or the motor discharge valve 82 may be shifted to the respective open positions so that the pressurized hydraulic fluid stored in the HP accumulator 72 may be reused. For example, as described below, the pressurized hydraulic fluid may be supplied by the HP accumulator 72 to the hydraulic cylinders 30 to perform a desired movement and/or to the motor 84 to generate mechanical energy output.

The cylinder discharge valve 78 may be located in a fluid line fluidly connecting the HP accumulator 72 and the hydraulic cylinders 30, e.g., to selectively place the HP accumulator 72 into fluid communication with both head-end chambers 40. In an embodiment, the cylinder discharge valve 78 may be shifted to an open position while the accumulator charge valve 74 and the motor discharge valve 82 are in closed positions, thus creating a flow path between the HP accumulator 72 and the head-end chambers 40 such that pressurized hydraulic fluid in the HP accumulator 72 may be supplied to the head-end chambers 40 simultaneously to extend the hydraulic cylinders 30. The cylinder discharge valve 78 may also work in conjunction with the check valve 80 such that when the cylinder discharge valve 78 is in the open position, the check valve 80 may allow pressurized hydraulic fluid to flow from the HP accumulator 72 to the head-end chambers 40, but not in the reverse direction.

The motor discharge valve 82 may be located in a fluid line fluidly connecting the HP accumulator 72 and the motor 84, e.g., to selectively place the HP accumulator 72 into fluid communication with the motor 84. In an embodiment, the motor discharge valve 82 may be shifted to an open position while the accumulator charge valve 74 and the cylinder discharge valve 78 are in closed positions, thus creating a flow path between the HP accumulator 72 and the motor 84 such that pressurized hydraulic fluid in the HP accumulator 72 may be supplied to the motor 84 to produce a mechanical energy output (e.g., to assist in driving the pump 54).

The motor 84 may be a variable-displacement motor coupled to the power source 18 and/or the pump 54. The motor 84 may be configured to receive pressurized fluid from the HP accumulator 72 and discharge the fluid into the tank 52. The motor 84 may use the energy contained within the pressurized fluid to generate a mechanical energy output that is passed to the pump 54 and/or other components. For example, as shown in FIG. 2, the motor 84 may be connected to a pump shaft of the pump 54, and the pump shaft may also be driven by the power source 18. Alternatively, the pump 54 may be connected to the motor 84 and/or the power source 18 via another mechanical arrangement, such as one or more mechanical connectors, e.g., gears, shafts, couplers, etc.

The energy recovery system 70 may also include a tank accumulator 90, a check valve 92, and a back pressure valve 94. In an embodiment, the tank accumulator 90 may be operatively connected to the rod-end chambers 38 via the C-T control valve 68. For example, when extension of the hydraulic cylinders 30 is desired, e.g., in the resistive load condition or other non-overrunning load condition, the C-T control valve 68 may be actuated to an open position while the C-T control valve 66 is actuated to a closed position, thus allowing pressurized hydraulic fluid exiting the rod-end chambers 38 to enter (or charge) the tank accumulator 90. Thus, hydraulic fluid exiting from the rod-end chambers 38 may be stored in the tank accumulator 90 for reuse at a later time.

The back pressure valve 94 may allow passage of pressurized hydraulic fluid back into the tank 52, e.g., to regulate the pressure of pressurized hydraulic fluid stored within the tank accumulator 90. For example, as previously described, pressurized hydraulic fluid leaving the rod-end chambers 38 may be directed through C-T control valve 68 and towards the tank accumulator 90, thus creating pressure within the tank accumulator 90 as pressurized hydraulic fluid is stored therein. As long as the pressure in the tank accumulator 90 remains below a predetermined pressure required to force the back pressure valve 94 to an open position, the tank accumulator 90 may continue to store more pressurized hydraulic fluid and the pressure in the tank accumulator 90 may continue to steadily increase. However, once the pressure within the tank accumulator 90 exceeds the predetermined pressure, the back pressure valve 94 may be forced into an open position, thus allowing the pressurized hydraulic fluid within the tank accumulator 90 to escape to the tank 52. Once enough fluid leaves the tank accumulator 90 to cause the pressure within the tank accumulator 90 to fall back below the predetermined pressure, then the back pressure valve 94 may return to its closed position. Thus, excess flow in the tank accumulator 90 may return to the tank 52 so that the pressure within the tank accumulator 90 may be consistently maintained at or below the predetermined pressure level. It is contemplated that the predetermined pressure level may be adjusted by adjusting the biasing pressure exerted by the back pressure valve 94.

The tank accumulator 90 may supply pressurized hydraulic fluid to the motor 84 when desired, e.g., when the motor 84 needs to be driven but there is not enough pressurized hydraulic fluid in the HP accumulator 72 (e.g., when the pressure in the HP accumulator 72 is lower than a threshold). In an embodiment, the motor discharge valve 82 may be shifted to a closed position and the check valve 92 may allow pressurized hydraulic fluid to flow from the tank accumulator 90 to the motor 84, but not in the reverse direction.

The energy recovery system 70 may also include a regeneration valve 96 and a check valve 98. The regeneration valve 96 may be disposed within one or more fluid lines that extend between the head-end chambers 40 and the rod-end chambers 38. When the regeneration valve 96 is shifted to an open position, some of the fluid discharged from the head-end chambers 40 may be directed to the rod-end chambers 38 (and/or vice versa), without the fluid first passing through the pump 54 and/or the HP accumulator 72. The regeneration valve 96 may also work in conjunction with the check valve 98 such that when the regeneration valve 96 is in the open position, the check valve 98 may allow pressurized hydraulic fluid to flow from the head-end chambers 40 to the rod-end chambers 38, but not in the reverse direction. Alternatively, instead of opening the regeneration valve 96, the P-C control valves 62 and 64 may be shifted to open positions simultaneously to allow some of the fluid discharged from the head-end chambers 40 to be directed to the rod-end chambers 38 (and/or vice versa), without the fluid first passing through the pump 54 and/or the HP accumulator 72.

For example, when retraction of the hydraulic cylinders 30 is desired, e.g., in the overrunning load condition, the regeneration valve 96 may be shifted to the open position to allow pressurized hydraulic fluid to flow from the head-end chambers 40 to the rod-end chambers 38. As a result, when there may not be enough pressurized hydraulic fluid being supplied to the rod-end chambers 38 by the pump 54 (such as when the pump 54 is also supplying pressurized hydraulic fluid to other hydraulic cylinders, e.g., for moving the stick 24 and/or the work tool 14), the regeneration valve 96 may be operated to directly supply pressurized hydraulic fluid from the head-end chambers 40 to the rod-end chambers 38 to assist in maintaining a desired speed for the retraction of the hydraulic cylinders 30 and to avoid having to limit the speed of the hydraulic cylinders 30.

The regeneration valve 96 may be opened at the same time as the accumulator charge valve 74 so that pressurized hydraulic fluid may be supplied from the head-end chambers 40 to both the HP accumulator 72 and the rod-end chambers 38 simultaneously. Alternatively, the regeneration valve 96 may be opened when the accumulator charge valve 74 is closed so that the pressurized hydraulic fluid from the head-end chambers 40 may be supplied to the rod-end chambers 38 only.

During operation of the machine 10, the operator of the machine 10 may utilize the interface device (not shown) to provide a signal that identifies a desired movement of the hydraulic cylinders 30 to a controller 100. Based upon one or more signals, including the signal from the interface device (not shown) and, for example, signals from various pressure, temperature, and/or position sensors 102 located throughout the hydraulic system 50, the controller 100 may command movement of the different valves 62, 64, 66, 68, 74, 78, 82, and 96 and/or displacement changes of the pump 54 and the motor 84 to move the hydraulic cylinders 30 to a desired position in a desired manner (i.e., at a desired speed and/or with a desired force). For example, the sensors 102 may include an accumulator pressure sensor 102A configured to determine a pressure associated with the pressurized hydraulic fluid stored in and/or supplied to the HP accumulator 72, one or more cylinder pressure sensors 102B configured to determine a pressure associated with the pressurized hydraulic fluid stored in and/or supplied to the head-end chambers 40, and/or a pump pressure sensor 102C configured to determine a pressure associated with the pressurized hydraulic fluid supplied from the pump 54. As shown in FIG. 2, other sensors may be provided, such as sensors 102 configured to determine a temperature of the pressurized hydraulic fluid stored in the HP accumulator 72, a pressure of the hydraulic fluid directed from the motor discharge valve 82 to the motor 84, a displacement of the motor 84, spool displacement sensors for the respective P-C control valves 62 and 64, a pressure of the hydraulic fluid supplied from the pump 54 and directed to the P-C control valves 62 and 64, and pressures of the hydraulic fluid stored in, supplied to, or discharged from the respective head-end and rod-end chambers 38 and 40.

The controller 100 may embody a single microprocessor or multiple microprocessors that include components for controlling operations of the hydraulic system 50 based on input from an operator of the machine 10 and based on sensed or other known operational parameters. Numerous commercially available microprocessors can be configured to perform the functions of the controller 100. It should be appreciated that the controller 100 could readily be embodied in a general machine microprocessor capable of controlling numerous machine functions. The controller 100 may include a memory, a secondary storage device, a processor, and any other components for running an application. Various other circuits may be associated with the controller 100 such as power supply circuitry, signal conditioning circuitry, solenoid driver circuitry, and other types of circuitry.

One or more additional check valves 104 may be provided to assist in regulating the flow of hydraulic fluid, e.g., discharged from the pump 54 and/or the hydraulic cylinders 30. Also, one or more relief valves 106 may be provided to allow fluid relief from the hydraulic system 50 into the tank 52 when a pressure of the hydraulic fluid exceeds a set threshold of the relief valve 106.

Figure 3:
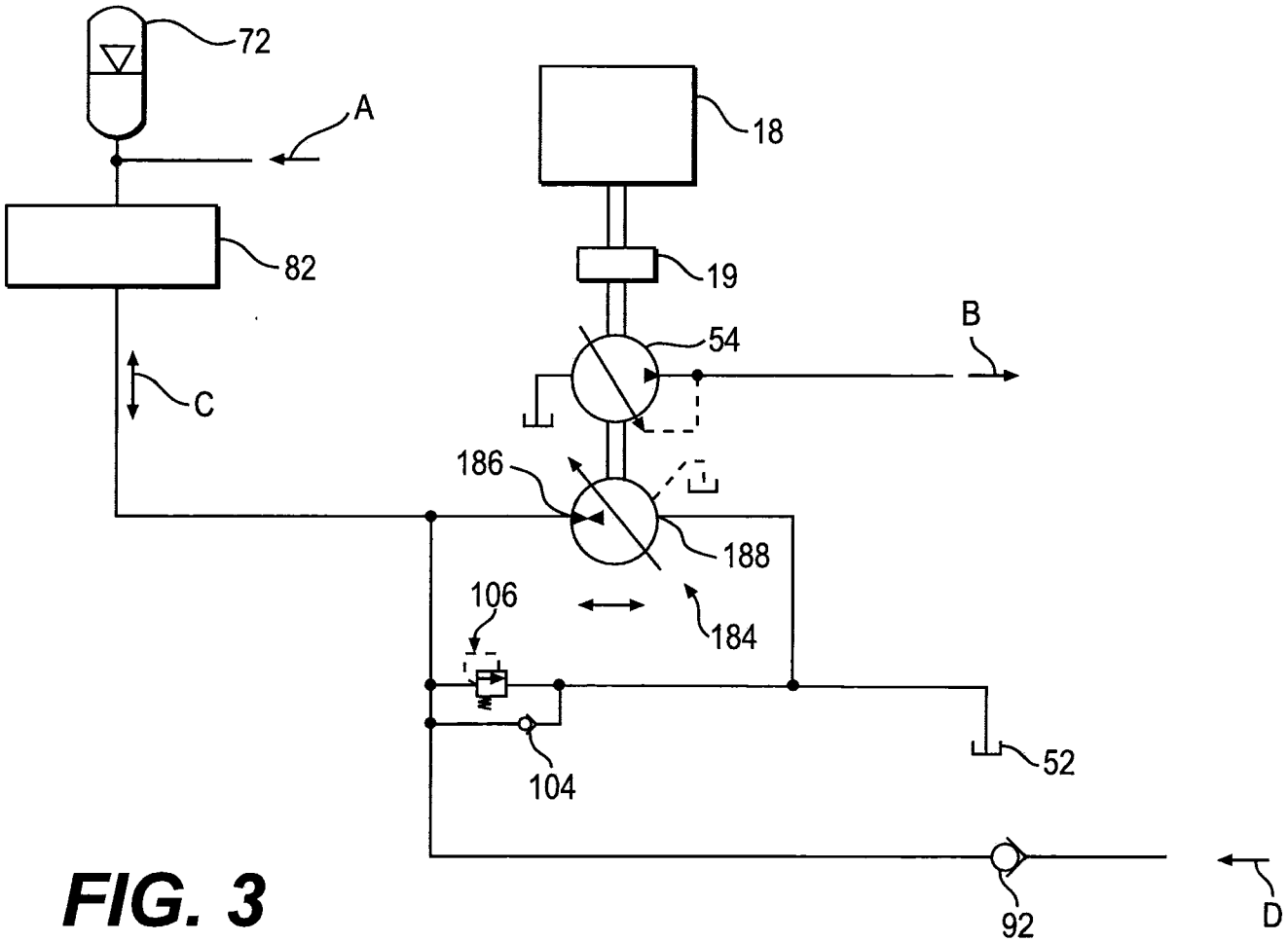
FIG. 3 is a schematic illustration of an exemplary disclosed system that may be used in conjunction with the machine of FIG. 1, according to another embodiment.

As shown in FIG. 3, a variable-displacement over-center pump/motor 184 and its associated fluid lines may be substituted for the motor 84 and its associated fluid lines shown in FIG. 2. The hydraulic subsystem shown in FIG. 3 may be provided in the hydraulic system 50 shown in FIG. 2 and for ease of illustration components of the hydraulic system 50 have been omitted from FIG. 3. As indicated by arrow A, the HP accumulator 72 may receive pressurized hydraulic fluid, e.g., via the accumulator charge valve 74 as described above in connection with FIG. 2. As indicated by arrow B, the pump 54 may supply pressurized hydraulic fluid to the hydraulic cylinders 30, e.g., via the cylinder control valve assembly 60 as described above in connection with FIG. 2.

The over-center pump/motor 184 may be selectively configured to operate as a pump or motor, e.g., depending on the position (e.g., tilt angle) of a swashplate (not shown) of the over-center pump/motor 184. The position of the swashplate may be controlled using the controller 100. As shown by arrow C, the direction of flow with respect to the over-center motor 184 may be adjusted, depending on the operation of the over-center pump/motor 184. The over-center pump/motor 184 may include a first port 186 and a second port 188. When flow is directed from the motor discharge valve 82 to the over-center pump/motor 184, the first port 186 serves as an inlet and the second port 188 serves as an outlet. When flow is directed in the opposite direction (from the over-center pump/motor 184 to the motor discharge valve 82), the second port 188 serves as an inlet and the first port 186 serves as an outlet.

When the over-center pump/motor 184 is operating as a motor, the first port 186 may serve as an inlet and the second port 188 may serve as an outlet. Thus, the motor discharge valve 82 may be shifted to an open position to allow the first port 186 to receive pressurized hydraulic fluid from the HP accumulator 72 while the second port 188 may discharge fluid from the over-center pump/motor 184 into the tank 52. The over-center pump/motor 184 may use the energy contained within the pressurized fluid to generate a mechanical energy output that is passed to the pump 54 and/or other components. As indicated by arrow D, the over-center pump/motor 184 may receive pressurized hydraulic fluid from other components, such as the tank accumulator 90, as described above in connection with FIG. 2, instead of the pressurized hydraulic fluid from the HP accumulator 72. For example, the motor discharge valve 82 may be shifted to a closed position and the check valve 92 may allow pressurized hydraulic fluid to flow from the tank accumulator 90 to the motor 84, but not in the reverse direction.

When the over-center pump/motor 184 is operating as a pump, the second port 188 may serve as an inlet and the first port 186 may serve as an outlet. Thus, the over-center pump/motor 184 may draw hydraulic fluid from the tank 52 at ambient or low pressure at the second port 188, and may convert mechanical energy or power (e.g., from the power source 18) to hydraulic energy or power by pressurizing the hydraulic fluid. The pressurized hydraulic fluid flow may exit through the first port 186. The motor discharge valve 82 may be shifted to an open position to supply the pressurized hydraulic fluid to the HP accumulator 72 to store the energy and use it through discharge later.

Figure 4:
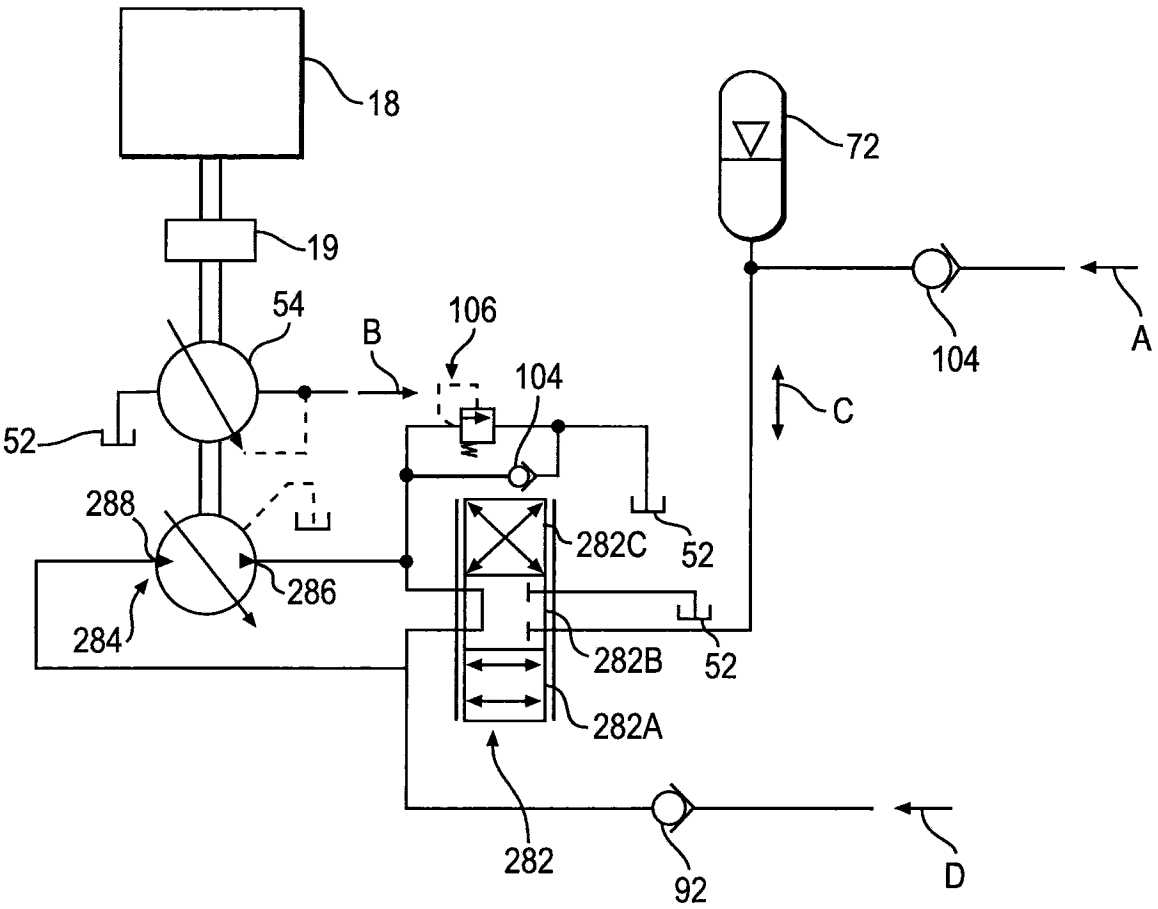
FIG. 4 is a schematic illustration of an exemplary disclosed system that may be used in conjunction with the machine of FIG. 1, according to a further embodiment.

Alternatively, as shown in FIG. 4, a switching valve 282, a variable-displacement pump/motor 284, and associated fluid lines may be substituted for the motor discharge valve 82, the motor 84, and associated fluid lines shown in FIG. 2. The hydraulic subsystem shown in FIG. 4 may be provided in the hydraulic system 50 shown in FIG. 2 and for ease of illustration components of the hydraulic system 50 have been omitted from FIG. 4.

The pump/motor 284 may be selectively configured to operate as a pump or motor, e.g., depending on the position (e.g., tilt angle) of a swashplate (not shown) of the pump/motor 284. The position of the swashplate may be controlled using the controller 100. The pump/motor 284 may include an inlet port 286 and an outlet port 288. Unlike the over-center pump/motor 184 shown in FIG. 3, the ports 286 and 288 may not be capable of switching from inlet to outlet (and vice versa). Therefore, the switching valve 282 may be provided to control the direction of flow to the pump/motor 284. The switching valve 282 may be shifted between a first position 282A, a second position 282B, and a third position 282C.

When the pump/motor 284 is operating as a motor, the switching valve 282 may be shifted to the first position 282A to allow the inlet port 286 to receive pressurized hydraulic fluid from the HP accumulator 72 while the outlet port 288 may discharge fluid from the pump/motor 284 into the tank 52. The pump/motor 284 may use the energy contained within the pressurized fluid to generate a mechanical energy output that is passed to the pump 54 and/or other components.

When the switching valve 282 is shifted to the second position 282B, the pump/motor 284 is not fluidly connected to the HP accumulator 72 and therefore is not capable of charging or discharging the HP accumulator 72.

When the pump/motor 284 is operating as a pump, the switching valve 282 may be shifted to the third position 282C to allow the inlet port 286 to draw hydraulic fluid from the tank 52 at ambient or low pressure, and may convert mechanical energy or power (e.g., from the power source 18) to hydraulic energy or power by pressurizing the hydraulic fluid. The pressurized hydraulic fluid flow may exit through the outlet port 286 and supplied via the switching valve 282 to the HP accumulator 72. Thus, the HP accumulator 72 may be charged by operating the pump/motor 284 as a pump while the switching valve 282 is in the third position 282C.

INDUSTRIAL APPLICABILITY

The disclosed hydraulic system 50 may have particular applicability with machines to allow recovery and/or reuse of potential energy associated with movement of the implement system 12 operatively connected to one or more hydraulic cylinders (e.g., the hydraulic cylinders 30) or other hydraulic actuators. Operation of the hydraulic system 50 will now be described.

During operation of the machine 10, an operator located within the operator station 20 may command a particular motion of work tool 14 in a desired direction and at a desired velocity by way of an interface device. One or more corresponding signals generated by the interface device may be provided to the controller 100 indicative of the desired motion, along with machine performance information, for example data from the sensors 102 such pressure data, position data, temperature data, speed data, pump and/or motor displacement data, and other data known in the art.

The controller 100 may generate control signals directed to one or more of the pump 54, the motor 84, the pump/motor 184 or 284, the valve(s) 62, 64, 66, 68, 74, 78, 82, 96, and/or 282, and/or other components of the hydraulic system 50. For example, based on the signals from the interface device, the controller 100 may determine whether to extend or retract the hydraulic cylinders 30, and the speed and direction of movement of the hydraulic cylinders 30. The controller 100 may also determine whether to open the accumulator charge valve 74 and/or operate the pump/motor 184 or 284 to charge the HP accumulator 72. The controller 100 may also determine whether to discharge the HP accumulator 72 by supplying the pressurized hydraulic fluid to the head-end chambers 40 (e.g., by opening the cylinder discharge valve 78) to assist in extending the hydraulic cylinders 30, and/or by supplying the pressurized hydraulic fluid to the motor 84, the pump/motor 184, or the pump/motor 284 (e.g., via the motor discharge valve 82 or the switching valve 282) to assist in driving the pump 54 or other components.

The following discussion relates to the operation of the hydraulic circuit 50 including the motor 84, but it is understood that the same description applies to a similar hydraulic circuit including either the pump/motor 184 or 284.

Retraction of the hydraulic cylinders 30 to lower the boom 22 from a raised position may be driven by the force of gravity acting on the raised boom 22 and/or the force of gravity on the load carried by the work tool 14. Those forces may act on the pistons 34 to push pressurized hydraulic fluid out of the head-end chambers 40. That pressurized hydraulic fluid may then be directed into the HP accumulator 72 via the accumulator charge valve 74 where it may be stored and/or directed into the rod-end chambers 38 via the regeneration valve 96 or the P-C control valves 62 and 64 to assist in maintaining a desired speed for the retraction of the hydraulic cylinders 30.

Extension of the hydraulic cylinders 30 to raise the boom 22 may include supplying pressurized hydraulic fluid, provided by the pump 54, into the head-end chambers 40 while allowing pressurized hydraulic fluid in the rod-end chambers 38 to return to the tank 52. As pressurized hydraulic fluid exits from the rod-end chambers 38, it may be directed towards the tank accumulator 90 so that the tank accumulator 90 may store the pressurized hydraulic fluid and the energy associated therewith.

The stored pressurized hydraulic fluid in the HP accumulator 72 may be used to provide power to assist in subsequent movements of the boom 22, e.g., towards the head-end chambers 40 to extend the hydraulic cylinders 30. For example, the controller 100 may open the cylinder discharge valve 78 (e.g., while closing the motor discharge valve 82) to supply the pressurized hydraulic fluid from the HP accumulator 72 to the head-end chambers 40 to assist in extending the hydraulic cylinders 30 and/or to supplement the flow from the pump 54, which may pressurize hydraulic fluid drawn from the tank 52 and direct the pressurized hydraulic fluid to the head-end chambers 40. Alternatively, the controller 100 may open the motor discharge valve 82 (e.g., while closing the cylinder discharge valve 78) to supply the pressurized hydraulic fluid from the HP accumulator 72 to the motor 84 to assist in driving the pump 54.

The controller 100 may determine when to open the cylinder discharge valve 78 or the motor discharge valve 82 at least based on the pressure associated with the head-end chambers 40 (e.g., based on the sensed pressure from the cylinder pressure sensor 102B) and the pressure associated with the HP accumulator 72 (e.g., based on a sensed pressure from the accumulator pressure sensor 102A). For example, the controller 100 may open the motor discharge valve 82 when the pressure associated with the head-end chambers 40 is greater than the pressure associated with the HP accumulator 72. The controller 100 may also open the motor discharge valve 82 when the pressure associated with the head-end chambers 40 is less than the pressure associated with the HP accumulator 72 and when the difference in the two pressures is relatively high (e.g., greater than a threshold such as approximately 10 bar, approximately 20 bar, approximately 30 bar, approximately 40 bar, etc.). Supplying pressurized hydraulic fluid from the HP accumulator 72 to the motor 84 to assist in driving the pump 54 may reduce the burden on the power source 18, which therefore may reduce fuel consumption.

On the other hand, the controller 100 may open the cylinder discharge valve 78 when the pressure associated with the head-end chambers 40 is less than the pressure associated with the HP accumulator 72 and when the difference in the two pressures is relatively small (e.g., less than a threshold such as approximately 10 bar, approximately 20 bar, approximately 30 bar, approximately 40 bar, etc.). Opening the cylinder discharge valve 78 when there is a relatively small pressure drop may reduce the amount of heat that may be generated due to the pressure drop. Also, since the motor 84 is not used to supply pressurized hydraulic fluid from the HP accumulator 72 to the head-end chambers 40 via the cylinder discharge valve 78, any potential losses in energy due to the motor's energy conversion efficiency may be avoided. Also, since the pump 54 is not used to supply pressurized hydraulic fluid from the HP accumulator 72 to the head-end chambers 40 via the cylinder discharge valve 78, the burden on the power source 18 may be reduced, thereby reducing fuel consumption.

Since the pressurized hydraulic fluid may be supplied from the HP accumulator 72 to the head-end chambers 40 or the motor 84, pressurized hydraulic fluid may not be supplied directly from the HP accumulator 72 to the pump 54. As a result, the pump 54 does not have be designed specifically to receive pressurized hydraulic fluid in addition to the low-pressure hydraulic fluid from the tank 52.

The controller 100 may also determine which one of the cylinder discharge valve 78 or the motor discharge valve 82 to open based on the pressure associated with the pump 54 (e.g., based on a sensed pressure from the pump pressure sensor 102C) in addition to the pressures associated with the head-end chambers 40 and the HP accumulator 72. In certain applications, the hydraulic system 50 may include multiple hydraulic actuators associated with different desired pressures or loads (e.g., the hydraulic cylinders 30, one or more hydraulic cylinders for moving the stick 24, and/or one or more hydraulic cylinders for moving the work tool 14). The pump 54 may supply pressurized hydraulic fluid to the multiple hydraulic actuators simultaneously. Outlet pressure of the pump 54 may be determined based on the highest desired pressure (load) of the multiple hydraulic actuators connected to the pump 54. However, if the pressure of the pressurized fluid supplied by the pump 54 is higher than the pressure associated with the head-end chambers 40, then there may be a pressure drop across the P-C control valve 62, which may generate heat depending on the pressure difference. Thus, when the cylinder discharge valve 78 is opened, there may be a pressure drop (and corresponding heat generation) depending on the difference in pressure associated with the head-end chambers 40 and the HP accumulator 72. When the motor discharge valve 82 is opened, there may be a pressure drop (and corresponding heat generation) depending on the difference in pressure associated with the head-end chambers 40 and the pump 54. The controller 100 may determine which one of the cylinder discharge valve 78 or the motor discharge valve 82 to open based on which valve 78 or 82 may produce the smaller pressure drop, which may reduce heat generation.

For example, the controller 100 may determine a first difference between the pressure associated with the head-end chambers 40 and the pressure associated with the HP accumulator 72, and a second difference between the pressure associated with the head-end chambers 40 and the pressure associated with the pump 54. The controller 100 may open the motor discharge valve 82 when the second difference is less than the first difference and/or when the pump 54 is delivering pressurized fluid to another hydraulic actuator other than the hydraulic cylinders 30 (e.g., when any of the hydraulic actuators is in a non-overrunning load condition), and may open the cylinder discharge valve 78 when the first difference is less than the second difference. As a result, pressure drops may be reduced, which may reduce the amount of heat generated in the hydraulic system 50 and may save energy accordingly.

As the stored pressurized hydraulic fluid within the HP accumulator 72 is used up, the pressure within the HP accumulator 72 may drop accordingly. When the controller 100 determines that the pressure associated with the HP accumulator 72 falls below a predetermined level, e.g., based on a sensed pressure from the accumulator pressure sensor 102A, the controller 100 may close the motor discharge valve 82 and the cylinder discharge valve 78 and the pressurized fluid in the tank accumulator 90 may be supplied to the motor 84, allowing the motor 84 to drive the pump 52 as the pressurized hydraulic fluid in the HP accumulator 72 nears depletion.

When the energy recovery system 70 includes the pump/motor 184 or 284, the HP accumulator 72 may also be charged by operating the pump/motor 184 or 284 as a pump. For example, the pump/motor 184 or 284 may be operated as a pump when the power source 18 is idling, has a lower load, and/or has a lower power requirement (e.g., if the power requirement of the power source 18 is less than a maximum power output of the power source 18, below a threshold (e.g., below approximately 200 kW, approximately 150 kW, approximately 100 kW, approximately 50 kW, etc.), etc.), and/or when the HP accumulator 72 has a lower pressure. However, when the power source 18 is not idling, has a higher load, and/or has a higher power requirement (e.g., if the power requirement of the power source 18 is greater than the power output), and/or the pressure in the HP accumulator 72 is above a threshold, the pump/motor 184 or 284 may be operable as a motor to discharge the HP accumulator 72 for generating a mechanical power output that assists in driving the pump 54 and/or other components. Therefore, the pump/motor 184 or 284 provides a peak shaving function that may permit more efficient operation of the power source 18 and therefore may also allow for a reduction in size of the power source 18.

Thus, the energy recovery system 70 may provide for the recovery and/or reuse of energy by capturing the energy which was previously throttled to tank and lost as heat, and by storing the energy in the HP and tank accumulators 72 and 90. Then, when an operator desires to once again raise the boom 22 by extending the hydraulic cylinders 30, the stored energy, in the form of pressurized hydraulic fluid, may be recirculated to the head-end chambers 40 or to the motor 84, 184, or 284. This reuse of energy may improve machine efficiency and reduce fuel costs (e.g., by helping to reduce a load on the power source 18) and overall operating costs, while still satisfying operator demands.

It will be apparent to those skilled in the art that various modifications and variations can be made to the disclosed hydraulic system. Other embodiments will be apparent to those skilled in the art from consideration of the specification and practice of the disclosed hydraulic system. It is intended that the specification and examples be considered as exemplary only, with a true scope being indicated by the following claims and their equivalents.

What is claimed is:

1. A hydraulic system comprising:

a hydraulic actuator;

a pump configured to supply fluid to the hydraulic actuator;

a first accumulator fluidly connected to the hydraulic actuator and configured to store fluid received from the hydraulic actuator;

a motor drivingly connected to the pump and fluidly connected to the first accumulator, the motor being configured to receive the stored fluid from the first accumulator to drive the pump; and a first discharge valve fluidly connected between the first accumulator and the hydraulic actuator, the first discharge valve being configured to supply the stored fluid from the first accumulator to the hydraulic actuator without the stored fluid from the first accumulator circulating through the pump when an actuator pressure associated with the fluid supplied to the hydraulic actuator is less than an accumulator pressure associated with the stored fluid in the first accumulator, and a difference between the accumulator and actuator pressures is smaller than a threshold.

2. The hydraulic system of claim 1, further including a controller connected to the first discharge valve, the controller being configured to receive a command to provide fluid to the hydraulic actuator, and in response to the command, open the first discharge valve to direct the stored fluid from the first accumulator to the hydraulic actuator without the stored fluid from the first accumulator circulating through the pump.

3. The hydraulic system of claim 1, further including a second discharge valve fluidly connected between the first accumulator and the motor, the second discharge valve being configured to supply the stored fluid from the first accumulator to the motor.

4. The hydraulic system of claim 3, further including a controller connected to the second discharge valve and the motor, the controller being configured to receive a command to provide fluid to the hydraulic actuator, and in response to the command, open the second discharge valve to direct the stored fluid from the first accumulator to the motor so that the motor drives the pump.

5. The hydraulic system of claim 3, further including:

an accumulator pressure sensor configured to determine the accumulator pressure;

an actuator pressure sensor configured to determine the actuator pressure; and a controller connected to the first discharge valve, the second discharge valve, the accumulator pressure sensor, and the actuator pressure sensor, the controller being configured to:

open the first discharge valve, and open the second discharge valve when a condition associated with the accumulator pressure and the actuator pressure is satisfied.

6. The hydraulic system of claim 5, wherein the condition includes the actuator pressure being less than the accumulator pressure and a difference between the accumulator and actuator pressures being greater than the threshold.

7. The hydraulic system of claim 5, wherein the second condition includes the actuator pressure being greater than the accumulator pressure.

8. The hydraulic system of claim 5, wherein the controller is further configured to determine a first difference between the actuator pressure and the accumulator pressure and a second difference between the actuator pressure and a pump pressure associated with the fluid supplied by the pump, and open the first discharge valve when the first difference is less than the second difference.

9. The hydraulic system of claim 5, wherein the controller is further configured to determine a first difference between the actuator pressure and the accumulator pressure and a second difference between the actuator pressure and a pump pressure associated with the fluid supplied by the pump, the condition including the second difference being less than the first difference.

10. The hydraulic system of claim 1, wherein the pump is configured to convert mechanical power from a power source to hydraulic power for pressurizing the fluid supplied to the hydraulic actuator.

11. The hydraulic system of claim 1, wherein:

the hydraulic actuator is a hydraulic cylinder configured to move a boom that is movably connected to a body of a machine, the hydraulic cylinder being one of a plurality of hydraulic cylinders, the pump is selectively configured to supply fluid to a plurality of first chambers of the plurality of hydraulic actuators in parallel and supply fluid to a plurality of second chambers of the plurality of hydraulic actuators in parallel;

in an overrunning load condition, the first accumulator is configured to store fluid received from the plurality of first chambers; and in a non-overrunning load condition, the motor is configured to receive the stored fluid from the first accumulator to drive the pump to supply fluid to the plurality of first chambers.

12. The hydraulic system of claim 11, further including a second accumulator fluidly connected between the hydraulic actuator and a tank, the second accumulator being configured to store fluid received from the plurality of second chambers, the motor being configured to receive the stored fluid from the second accumulator to drive the pump.

13. A method of recovering and reusing energy with a hydraulic system, the method comprising:

directing fluid from a hydraulic actuator to a first accumulator to store fluid in the first accumulator;

determining an accumulator pressure associated with the fluid stored in the first accumulator;

determining an actuator pressure associated with fluid supplied to the hydraulic actuator;

directing the stored fluid from the first accumulator to the hydraulic actuator without circulating the stored fluid from the first accumulator through a pump when the actuator pressure is less than the accumulator pressure, and a difference between the accumulator and actuator pressures is smaller than a threshold; and directing the stored fluid from the first accumulator to a motor driving the pump when a condition associated with the accumulator and actuator pressures is satisfied.

14. The method of claim 13, wherein the difference is a first difference, and the stored fluid is directed from the first accumulator to the hydraulic actuator when a second difference between the actuator pressure and the accumulator pressure is less than a third difference between the actuator pressure and a pump pressure associated with fluid supplied by the pump.

15. The method of claim 13, wherein the hydraulic actuator is a first hydraulic actuator, the difference is a first difference, and the condition includes at least one of:

a second difference between the actuator pressure and the accumulator pressure being greater than a third difference between the actuator pressure and a pump pressure associated with fluid supplied by the pump; and the pump delivering pressurized fluid to a second hydraulic actuator separately from the first hydraulic actuator.

16. A hydraulic system comprising:

a hydraulic actuator;

a first pump configured to supply fluid to the hydraulic actuator;

a power source configured to supply power to drive the first pump;

a first accumulator fluidly connected to the hydraulic actuator and configured to store fluid received from the hydraulic actuator;

a device drivingly connected to the first pump, the device being configured to operate in a first mode as a motor to receive the stored fluid from the first accumulator to drive the first pump, and configured to operate in a second mode as a second pump to supply pressurized fluid to the first accumulator; and a first discharge valve fluidly connected between the first accumulator and the hydraulic actuator, the first discharge valve being configured to supply the stored fluid from the first accumulator to the hydraulic actuator without the stored fluid from the first accumulator circulating through the first pump when an actuator pressure associated with the fluid supplied to the hydraulic actuator is less than an accumulator pressure associated with the stored fluid in the first accumulator, and a difference between the accumulator and actuator pressures is smaller than a threshold.

17. The hydraulic system of claim 16, wherein the threshold is a first threshold and the device is configured to operate in the second mode when at least one of:

a power requirement for the power source is below a threshold, the power requirement is below a power output of the power source, the power source is idling, and the pressure in the first accumulator is below a second threshold.

18. The hydraulic system of claim 16, further including a switching valve fluidly connected between the first accumulator and the device, the switching valve being configured to control the direction of flow between the first accumulator and the device.

* * * * *